United States Patent [19]

Svensson

[11] 4,271,652

[45] Jun. 9, 1981

[54] FACING

[76] Inventor: Åke Svensson, Kryddgårdsvägen 83, 145 73 Norsborg, Sweden

[21] Appl. No.: 59,597

[22] Filed: Jul. 23, 1979

[51] Int. Cl.[3] ..... E04B 1/00

[52] U.S. Cl. ..... 52/478; 52/520; 52/235

[58] Field of Search ..... 52/478, 520, 588, 235

[56] References Cited

U.S. PATENT DOCUMENTS

| | | | |
|---|---|---|---|
| 2,535,620 | 12/1950 | Alvarez | 52/520 X |
| 2,642,968 | 6/1953 | Roush et al. | 52/520 |
| 2,820,535 | 1/1958 | Hutchison | 52/520 |
| 3,373,534 | 3/1968 | Berridge | 52/478 |

*Primary Examiner*—J. Karl Bell

*Attorney, Agent, or Firm*—LeBlanc, Nolan, Shur & Nies

[57] ABSTRACT

Sheet metal building facing elements, a plurality of which can be assembled and fastened to buildings to present a smooth front. Each element at its upper and lower edges has bent upper and lower tongues forming complementary shapes of V-cross-section, and at its side edges has bent portions of different configuration. The bent tongues and bent side portions enable assembled interengagement of the various edges of adjacent facing elements. There are also facing elements configured for use on building corners and window and door recesses.

4 Claims, 9 Drawing Figures

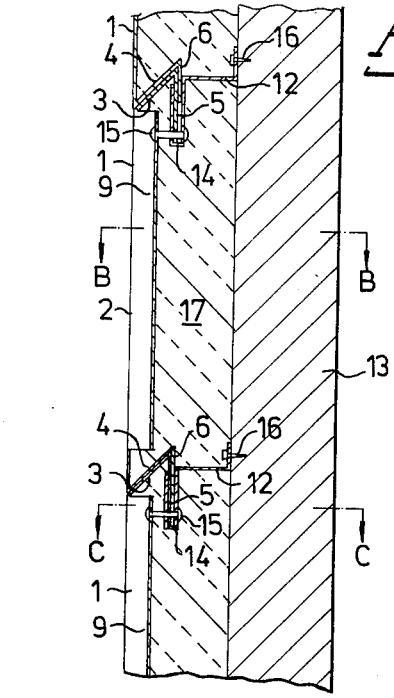
Fig. 5
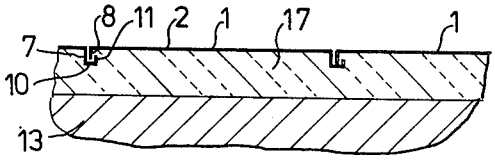
Fig. 6
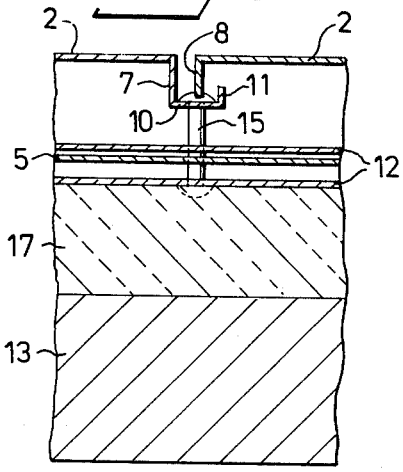
Fig. 7
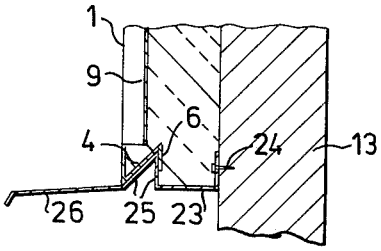
Fig. 8
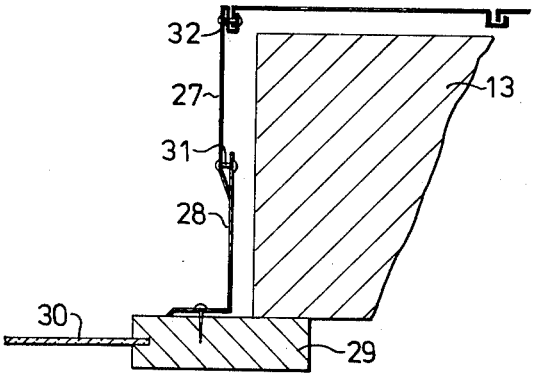
Fig. 9
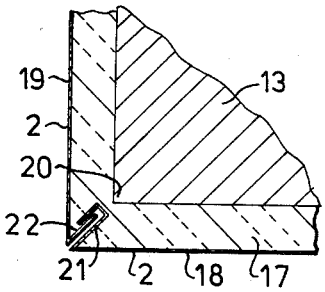

FACING

This invention relates to a facing of sheet metal for residential, factory and other buildings.

The invention, more precisely, relates to a facing comprising facing elements and means for attaching the same.

Facings of the aforementioned kind are previously known in a great number of designs and dimensions.

Conventional facings, however, which are assembled of a plurality of elements, which often have dimensions of about 0,5–1 m square, are designed so that between each element grooves or elevations are located, to which attachment means are provided. The conventional facing elements, thus, are not designed so as to create a substantially plane front.

Since recently facing elements are demanded, which render it possible to imitate a plastered front. In Swedish patent specification No. 11004/77, however, a facing element is disclosed which yields an entirely smooth front. This facing element is mounted by fitting screw heads or the like into keyhole-recesses in the elements. The mounting method is relatively difficult, but the difficulty is compensated for by the possibility of exchanging every mounted element without requiring any one of the remaining elements to be removed.

The present invention relates to a facing, which yields an entirely smooth front, has a simpler design, is easier and less expensive to manufacture and extremely simple to mount. The invention, thus, is an essential progress in several respects compared with said known facing elements.

The present invention relates to a facing of the kind defined in the preamble of the attached claim 1 and having substantially the characterizing features as defined in the characterizing clause of claim 1.

The invention is described in the following with reference to the accompanying drawings, in which FIGS. 1 and 2 show a facing element seen from the rear side from two different directions.

FIG. 5 is a vertical section of facing elements and their attachment means on a wall.

FIG. 6 is a section along the line B—B in FIG. 5.

FIG. 7 is a section along the line C—C in FIG. 5, slightly enlarged.

FIG. 8 is a section corresponding to that shown in FIG. 6 of facing elements and attachment means at a window or door recess.

FIG. 9 is a section corresponding to that shown in FIG. 6 of two facing elements in a corner, seen from above.

Figure 1:
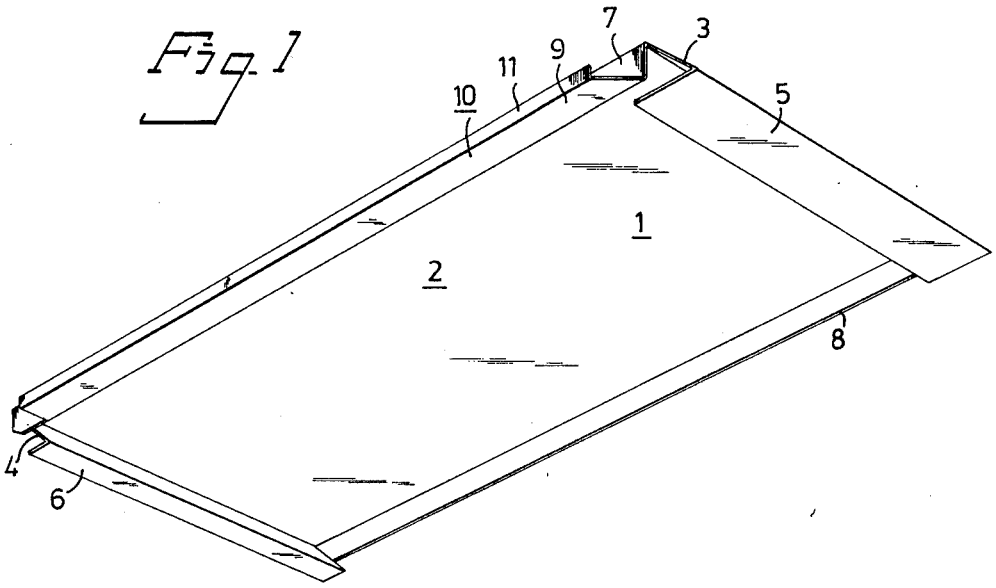
Figure 2:
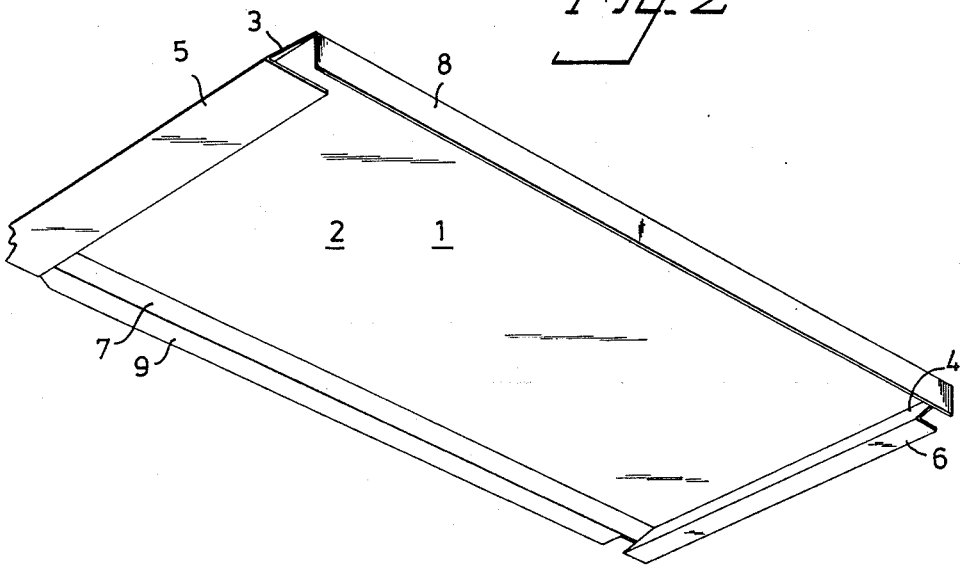
Figure 3:
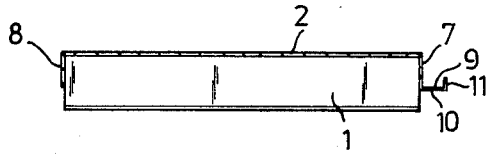
FIG. 3 is a section along the line A—A in FIG. 4.
Figure 4:
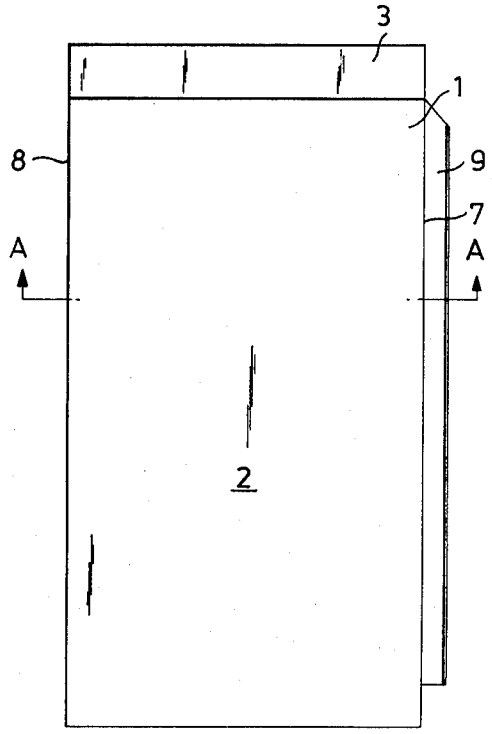
FIG. 4 shows the front side of a facing element seen straight from the front.

In FIGS. 1–4 a facing element 1 according to the invention is shown. In FIGS. 1 and 2 the upper surface 2 of the the facing element is shown seen from the rear side. Every facing element has a substantially plane upper surface intended to constitute the outer surface of a mounted front. From the upper and, respectively, lower short side of the facing element 1 an upper tongue 3 and, respectively, a lower tongue 4 are formed. The tongues 3,4 extend upward and in the direction from the upper surface 2 so as to form an angle with the upper surface. The upper tongue 3 as well as the lower one 4 are bent at their free ends, so that every tongue together with the associated bent portion 5,6 forms a V-shaped cross-section, as clearly appears from FIG. 5. The angle of the V is smaller than 90°. The free legs of the bent portions 5,6 are seen by way of a cross-section in parallel with the upper surface 2, which also appears clearly from FIG. 5.

From the plane upper surface 2 of every facing element, two parallel lateral edges 7,8 are bent downward to serve as the vertical side surfaces of the facing element. One, 7, of these lateral edges is bent at its free end to a U-shaped portion 9, the bottom 10 of which is in parallel with the upper surface. The free legs 11 of the U-shaped portion 9, further, preferably are in parallel with the lateral edge 7. The U-shaped portion 9, thus, forms a strip 9 projecting from the bent-down side surface 7 of the facing element 1.

The attachment means comprise a section 12 to be attached to a building wall 13 or the like by a suitable member 16. At one of its ends, which in mounted state of the section is the end farthest remote from the wall, the section 12 is formed to a portion 14 of U-shaped cross-section. The bent portion 5 of the upper tongue 3 of a facing element 1 and the bent portion 6 of the lower tongue 4 of a facing element located next above said aforementioned facing element are intended at the mounting of facing elements to be inserted into the U-shaped portions 14 of the attachment means, as can be seen in FIG. 5 where facing elements in mounted state are shown. The U-shaped portion 14 hereby retains the two facing elements in vertical and horizontal direction when the upper surfaces 2 of the facing elements are in a vertical plane. The bent portion 5 of the upper tongue 3 of the facing element 1 has such a length, that the bent portion 5 substantially or fully reaches to the bottom of the U-shaped portion 14 of the attachment means 12. When the facing element is being mounted, the bent portion 5 is connected to the U-shaped portion 14 by a screw 15, a rivet or the like, as shown in FIG. 5. Said screw or rivet preferably connects also the bottom 10 of said projecting strip 9 with the U-shaped portion, as shown in FIG. 5. Every facing element is attached preferably by only one screw or rivet, but in certain cases, depending a.o. on climatological conditions, several screws can be used. Alternatively, in many cases the facing element can be attached without using a screw at all.

The attachment means 12 according to a preferred embodiment comprises a bent sheet metal section, which has a length corresponding to a part of or to the entire horizontal length of a wall 13 or the like to be faced. The length of the attachment section 12 along the wall, however, also can be very short. The attachment section 12 preferably is designed so that the distance of the U-shaped portion from the building wall 13 permits the mounting of insulation material 17 between the wall 13 and the facing elements 1.

In the foregoing a building wall 13 has been mentioned, but the attachment means 12 can be secured also in frame work or the like.

In FIGS. 6 and 7 is shown how facing elements 1 are positioned and attached to the side of each other. FIG. 6, which is a section along the line B—B in FIG. 5 on a slightly reduced scale, shows that the downward bent side surface 8, which is not provided with a projecting strip, at the mounting is positioned in the U-shaped portion of the projecting strip 9 of a facing element located adjacent in horizontal direction. In FIG. 7 this is shown on an enlarged scale. FIG. 7, which is a section along the line C—C in FIG. 5, the screw or rivet 15 is indicated dashed in order to show how it connects a facing element with the attachment means 12.

FIG. 9 shows two facing elements 18,19, which agree with the previously shown facing elements 1, except for the configuration at the corner 20. At the facing elements 18,19, which are intended to constitute a corner of a building, so-called corner elements, their lateral edge 21,22 located at the corner is bent inward beneath the upper surface 2, so that the lateral edge on each corner element forms an angle of substantially 45° with the upper surface. The inward bent lateral edge 21 of one corner element 18 is bent at its free end to a U-shaped portion 23, into which the lateral edge 22 of the other corner element is intended to be inserted and secured by a screw, rivet or other connection (not shown).

In the lower part of FIG. 5 the attachment means 23 for a facing element 1 located lowermost on the wall is shown. The facing element 1, as mentioned, is provided farthest downwardly with its lower V-shaped portion, which consists of the lower tongue 4 and associated bent portion 6. The attachment means 23 consists of a bent sheet metal section to be secured in a building wall 13 by a suitable member 24 or the like, the cross-section of which at the location of the lower V-shaped portion 4,6 consists of a V-shaped portion 25, which substantially agrees with the form of the V-shaped portion 4,6 of the facing element 1. This attachment means, thus, locks the lower portion of the facing element against movement to and from the wall 13. The attachment means 23 further preferably comprises a portion 26 projecting from the front and formed to serve as a drip sheet.

Facing elements for front parts located perpendicularly to the plane of the main building front, such as about windows and doors, so-called window and door recess elements 27,28, are secured in the facing elements described above by a screw 32, rivet or the like, when the facing elements adjoin a window or door recess element. The window and door recess element may have any suitable design, but preferably it is formed as shown in FIG. 8 where a window or door recess element 27,28 is shown adjacent a windowframe 29 with associated window-pane 30. The two parts of the window or door recess element 27,28 are movable relative one another and fixed in position relative one another by a screw 31, rivet or the like.

When mounting facing elements 1 according to the invention, after some or all of the attachment means 12,23 have been mounted, first the lowermost elements 1 are attached by suspending them on the attachment means 12,23 and pushing them adjacent each other, so that two adjacent facing elements 1 engage with each other by a lateral edge 8 and a projecting strip 9. As appears from FIG. 7, the lateral edge 8 can be moved at the mounting into abutment to the lateral edge 7, so that an entirely smooth front is obtained. The next row of facing elements 1, counted upward, are suspended on the next following attachment means 12 and also fitted into the attachment means 12 located next below, as appears from FIG. 5.

The present invention, thus, provides a facing comprising facing elements and attachment means, which are extremely easy to mount. As appears from the aforesaid, in many cases it is only necessary to suspend the facing elements on the attachment means without screwing or riveting them. Even when only one screw or rivet is used, this reduces the working time and thereby the cost substantially compared with the mounting of known facings. Furthermore, a completely covering and substantially entirely smooth front is obtained.

A further advantage is the possibility of positioning the facing elements spaced from the building wall, so that additional insulation of insulated buildings or the insulation of uninsulated buildings is possible in a simple manner.

The invention must not be regarded restricted to the embodiments described above, but can be varied within the scope of the attached claims.

I claim:

1. A facing of sheet metal for residential, factory buildings and other units, comprising facing elements (1) and attachment means (12,23) for the same, where every facing element (1) has a substantially plane upper surface (2) intended to constitute the outer surface and where a tongue (3,4) is formed from the lower and, respectively, upper short side of the facing element, which tongues (3,4) extend upward and from the upper surface (2) to form an angle with the upper surface, and where the upper and the lower tongue (3,4) are bent at their free ends, so that every tongue (3,4) together with the associated bent portion (5,6) forms a V in cross-section, at which the angle of the V is smaller than 90°, where the free legs of the bent portions (5,6) in cross-section are substantially in parallel with said upper surface (2) and intended to be attached in a U-shaped portion of the attachment means, characterized in that the attachment means (12) includes a section intended to be attached horizontally lying on a building wall (13) or the like, which section consists of bent sheet metal and has a length corresponding to a part of or to the entire horizontal length of a wall (13) or the like to be faced, and which at its (12) outer end has said portion (14) of U-shaped cross-section into which the bent portion (5) of the upper tongue (3) of a facing element (1) and the bent portion (6) of the lower tongue (4) of a facing element (1) located next above said lastmentioned facing element (1) are intended to be inserted, and that the U-shaped portion (14) of the section retains both facing elements (1) in vertical and horizontal direction when the upper surfaces (2) of the facing elements (1) are in a vertical plane.

2. A facing as defined in claim 1, characterized in that from the plane upper surface (2) of every facing element (1) two parallel lateral edges (7,8) are bent down to constitute vertical sides of the facing element, and where one of said lateral edges (7) at its free end is bent to cross-sectional U-shape, and that the bottom (10) of the U is in parallel with the upper surface (2), so that the U forms a strip (9) projecting outward from the bent-down side surface (7) of the facing element (1).

3. A facing as defined in claim 1 or 2, characterized in that corner elements (18,19), i.e. facing elements (1) intended to be a corner of a building, have their lateral edge (21,22) located at the corner bent inward beneath the upper surface (2), so that the lateral edge (21,22) on every corner element (18,19) forms an angle of substantially 45° to the upper surface (2), and that the inward bent lateral edge (21) of one corner element (18) at its free end is bent to U-shape, into which U-shaped portion the bent lateral edge (22) of the other corner element (19) is intended to be inserted and be secured by screw, rivet or other connection.

4. A facing as defined in claims 1 or 2, characterized in that the attachment means (23) for the lower V-shaped portion of a facing element (1) located lowermost, which portion consists of the lower tongue (4) and associated bent portion (6), consists of a bent sheet metal section intended to be secured in a building wall (15) or the like, the cross-section of which at the location of the lower V-shaped portion of a facing element (1) consists of a V-shaped portion (25) agreeing substantially with the V-shaped portion (4,6) of the facing element (1), and that the attachment means (23) includes a portion (26) projecting from the front and formed as a drip sheet.

* * * * *